US010900292B2

(12) United States Patent
de Maindreville et al.

(10) Patent No.: US 10,900,292 B2
(45) Date of Patent: Jan. 26, 2021

(54) FIXED CUTTER DRILL BIT HAVING HIGH EXPOSURE CUTTERS FOR INCREASED DEPTH OF CUT

(71) Applicant: VAREL EUROPE S.A.S., Pau (FR)

(72) Inventors: Bruno Cuillier de Maindreville, Pau (FR); Gilles Gallego, Ibos (FR)

(73) Assignee: VAREL EUROPE S.A.S., Pau (FR)

( * ) Notice: Subject to any disclaimer, the term of this patent is extended or adjusted under 35 U.S.C. 154(b) by 0 days.

(21) Appl. No.: 16/156,214

(22) Filed: Oct. 10, 2018

(65) Prior Publication Data

US 2019/0234152 A1 Aug. 1, 2019

(30) Foreign Application Priority Data

Jan. 26, 2018 (EP) ..... 18305064

(51) Int. Cl.
*E21B 10/55* (2006.01)
*E21B 10/573* (2006.01)
*E21B 10/567* (2006.01)

(52) U.S. Cl.
CPC ..... *E21B 10/55* (2013.01); *E21B 10/5673* (2013.01); *E21B 10/573* (2013.01); *E21B 10/5735* (2013.01)

(58) Field of Classification Search
CPC .. E21B 10/55; E21B 10/5673; E21B 10/5735; E21B 10/573
USPC ..... 175/435
See application file for complete search history.

(56) References Cited

U.S. PATENT DOCUMENTS

| | | | | |
|---|---|---|---|---|
| 4,351,401 | A | 9/1982 | Fielder | |
| 4,877,096 | A | 10/1989 | Tibbits | |
| 5,431,239 | A * | 7/1995 | Tibbitts | E21B 10/567 175/428 |
| 5,709,279 | A * | 1/1998 | Dennis | E21B 10/5735 175/430 |
| 8,016,054 | B2 * | 9/2011 | Lancaster | E21B 10/567 175/327 |
| 9,303,460 | B2 | 4/2016 | Schwef | |
| 2009/0173548 | A1 * | 7/2009 | Voronin | B22F 7/062 175/435 |
| 2010/0264198 | A1 | 10/2010 | Voronin | |
| 2010/0314176 | A1 * | 12/2010 | Zhang | E21B 10/567 175/383 |
| 2017/0089144 | A1 * | 3/2017 | Cariveau | E21B 10/42 |

OTHER PUBLICATIONS

European Search Report; European Application No. 18305064.0—1002; dated Jun. 8, 2018.

* cited by examiner

*Primary Examiner* — James G Sayre

(57) ABSTRACT

A bit for drilling a wellbore includes: a body; and a cutting face forming a lower end of the bit. The cutting face includes: a blade protruding from the body and having a plurality of stud pockets formed in a bottom of the blade adjacent to a leading edge of the blade; a plurality of studs, each stud disposed in the respective pocket, mounted to the blade by a first braze material, and having a cutter pocket formed therein; a plurality of cutters, each cutter having a superhard cutting table attached to a cermet substrate, disposed in the respective cutter pocket, and mounted to the respective stud by a second braze material. An exposure of each cutter is greater than or equal to a diameter of the respective cutter.

12 Claims, 4 Drawing Sheets

FIXED CUTTER DRILL BIT HAVING HIGH EXPOSURE CUTTERS FOR INCREASED DEPTH OF CUT

BACKGROUND OF THE DISCLOSURE

Field of the Disclosure

The present disclosure generally relates to a fixed cutter drill bit having high exposure cutters for increased depth of cut.

Description of the Related Art

U.S. Pat. No. 4,351,401 discloses earth bore-hole drill bits embodying shaped preformed cutters containing hard abrasive materials, such as diamonds, the cutters being mounted in companion preformed sockets in the hard metal bit matrix. The extent of penetration of the preformed cutters into the formation being drilled is controlled by providing surface set diamonds embedded in the matrix at or adjacent to its gage portion, the surface set diamonds projecting from the matrix to a much lesser extent than the preformed cutters. As a result, the surface set diamonds can penetrate into the formation only to the extent determined by engagement of the adjacent face of the matrix with the formation. Although the preformed cutters project from the matrix to a greater distance than the surface set diamonds, their extent of penetration into the formation is no greater than that of the surface set diamonds.

U.S. Pat. No. 4,877,096 discloses a replaceable stud cutter for use in a matrix drag bit by furnacing a ductile metallic receptacle within the body of the drag bit as it is fabricated. The metal receptacle is characterized by having a receiving cavity defined therein and by including various mechanisms such as grooves or flares which facilitate retention of the metallic receptacle within the matrix body. The lowermost portion of the receptacle within the matrix body may also be shaped or tapered to allow dense packing of the receptacle adjacent to other receptacles along a given radial line on the bit face. A replaceable cutter is brazed, adhesively bonded and/or mechanically locked within the receiving cavity defined in the metal receptacle. When the replaceable cutter becomes worn through normal use, the mechanical locking elements can be drilled out, the brazing melted or adhesive dissolved to allow insertion of a new replacement cutter without causing any damage or alteration either to the receptacle, matrix body or bit face.

U.S. Pat. No. 5,431,239 discloses an improved stud design for an earth boring drill bit preferably using materials of different hardness and toughness layered to provide maximum resistance to surface abrasion coupled with excellent structural properties including high strength with maximum fracture toughness. The bit body is conventionally attached to a drill string, and has a crown and gage portion. The studs preferably include a core, made of steel or other material having high fracture toughness, covered at least in part with a hard, abrasion resistant material such as tungsten carbide. Each stud is secured to a socket in the bit body by means of brazing or other suitable means such as a press fit. The cutting element is brazed to a mounting face of the stud prior to affixation of the stud to the bit body and is preferably comprised of a polycrystalline diamond compact adhered to a backing layer of tungsten carbide.

U.S. Pat. No. 9,303,460 discloses earth-boring tools include a cutting element mounted to a body that comprises a metal or metal alloy, such as steel. A cutting element support member is mounted to the body rotationally behind the cutting element. The cutting element support member has an at least substantially planar support surface at a first end thereof, and a lateral side surface extending from the support surface to an opposing second end of the cutting element support member. The cutting element has a volume of superabrasive material on a first end of a substrate, and a lateral side surface extending from the first end of the substrate to an at least substantially planar back surface. The at least substantially planar back surface of the cylindrical substrate abuts an at least substantially planar support surface of the cutting element support member.

SUMMARY OF THE DISCLOSURE

The present disclosure generally relates to a fixed cutter drill bit having high exposure cutters for increased depth of cut. In one embodiment, a bit for drilling a wellbore includes: a body; and a cutting face forming a lower end of the bit. The cutting face includes: a blade protruding from the body and having a plurality of stud pockets formed in a bottom of the blade adjacent to a leading edge of the blade; a plurality of studs, each stud disposed in the respective pocket, mounted to the blade by a first braze material, and having a cutter pocket formed therein; a plurality of cutters, each cutter having a superhard cutting table attached to a cermet substrate, disposed in the respective cutter pocket, and mounted to the respective stud by a second braze material. An exposure of each cutter is greater than or equal to a diameter of the respective cutter.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
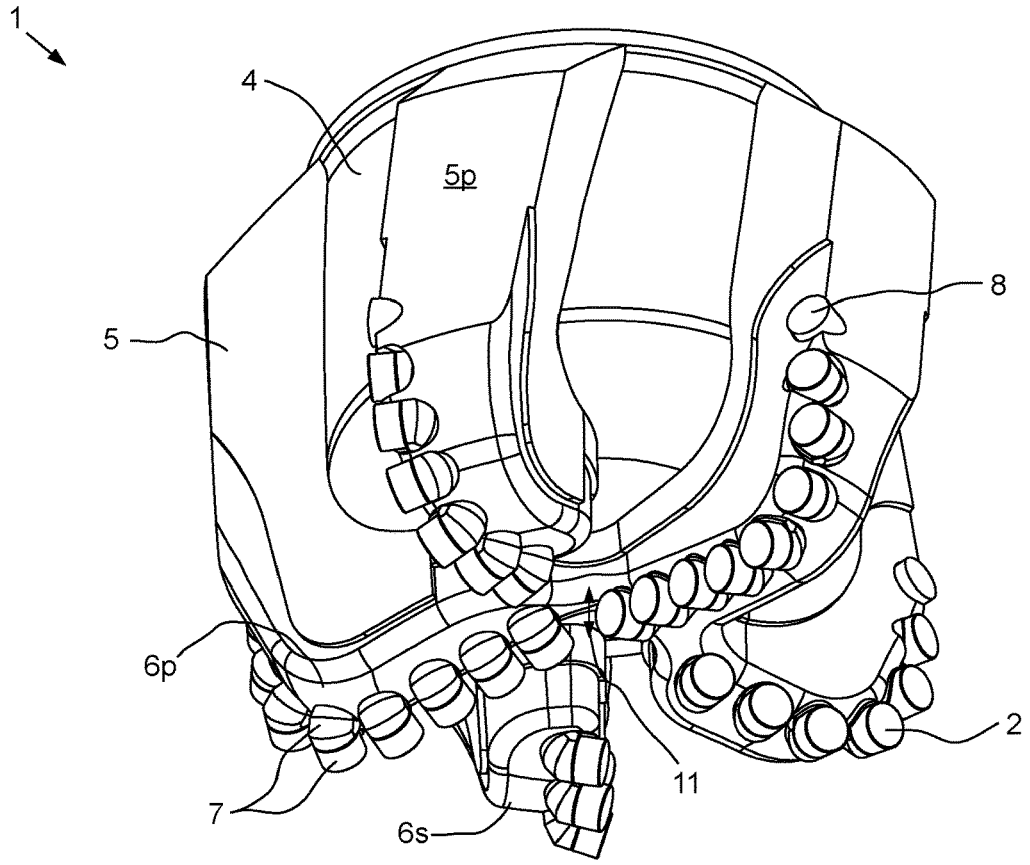
FIG. 1A illustrates a fixed cutter drill bit having high exposure cutters for increased depth of cut, according to one embodiment of the present disclosure.
Figure 1B:
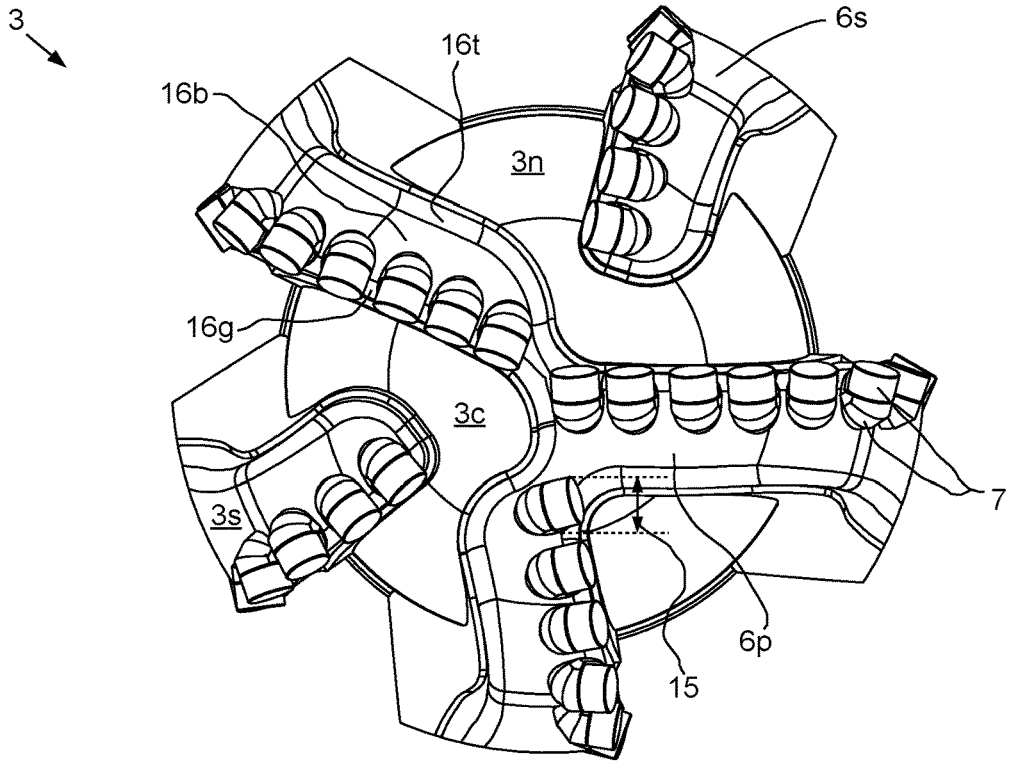
FIG. 1B illustrates a cutting face of the drill bit.

FIG. 1A illustrates a fixed cutter drill bit 1 having high exposure cutters 2 for increased depth of cut, according to one embodiment of the present disclosure. FIG. 1B illustrates a cutting face 3 of the drill bit 1.

The drill bit 1 may include a bit body 4, a shank (not shown), the cutting face 3, and a gage section 5. The shank may be tubular and include an upper piece and a lower piece connected to the upper piece, such as by threaded couplings secured by a weld. A lower portion of the bit body 4 may be made from a composite material, such as a ceramic and/or cermet body powder infiltrated by a metallic binder and an upper portion of the bit body 4 may be made from a softer material than the composite material of the upper portion, such as a metal or alloy shoulder powder infiltrated by the metallic binder. The bit body 4 may be mounted to the lower shank piece during molding thereof. The shank may be made from a metal or alloy, such as steel, and have a coupling, such as a threaded pin, formed at an upper end thereof for connection of the drill bit 1 to a drill collar (not shown). The shank may have a flow bore formed therethrough and the flow bore may extend into the bit body 4 to a plenum thereof. The cutting face 3 may form a lower end of the drill bit 1 and the gage section 5 may form at an outer portion thereof.

Alternatively, the bit body 4 may be metallic, such as being made from steel, and may be hardfaced. The metallic bit body may be connected to a modified shank by threaded couplings and then secured by a weld or the metallic bit body may be monoblock having an integral body and shank.

The cutting face 3 may include one or more (two shown) primary blades 6*p*, one or more (three shown) secondary blades 6*s*, fluid courses formed between the blades, and a plurality of cutter assemblies 7. The cutting face 3 may have one or more sections, such as an inner cone 3*c*, an outer shoulder 3*s*, and an intermediate nose 3*n* between the cone and the shoulder sections. The blades 6*p,s* may be disposed around the cutting face 3 and each blade may be formed during molding of the bit body 4 and may protrude from a bottom of the bit body. The primary blades 6*p* may be arranged about the cutting face 3 and the secondary blades 6*s* may be disposed between the primary blades. The primary blades 6*p* may each extend from a center of the cutting face 3, across the cone 3*c* and nose 3*n* sections, along the shoulder section 3*s*, and to the gage section 5. Two of the secondary blades 6*s* may each extend from a periphery of the cone section 3*c*, across the nose section 3*n*, along the shoulder section 3*s*, and to the gage section 5. One of the secondary blades may be extended from one of the primary blades 6*p* and may have an innermost cutter assembly 7 located at a periphery of the cone section 3*c*. Each blade 6*p,s* may extend generally radially across the cone 3*c* (primary only) and nose 3*n* sections with a slight spiral curvature and along the shoulder section 3*s* generally longitudinally with a slight helical curvature. Each blade 6*p,s* may be made from the same material as the bit body 4.

One or more ports (not shown) may be formed in the bit body 4 and each port may extend from the plenum and through the bottom of the bit body to discharge drilling fluid (not shown) along the fluid courses. A nozzle (not shown) may be disposed in each port and fastened to the bit body 4. Each nozzle may be fastened to the bit body 4 by having a threaded coupling formed in an outer surface thereof and each port may be a threaded socket for engagement with the respective threaded coupling. The ports may include an inner set of one or more ports disposed in the cone section 3*c* and an outer set of one or more ports disposed in the nose section 3*n* and/or shoulder section 3*s*.

The gage section 5 may define a gage diameter of the drill bit 1. The gage section 5 may include a plurality of gage pads 5*p*, such as one gage pad for each blade 6*p,s*, a trimmer 8 for each gage pad, and junk slots formed between the gage pads. The junk slots may be in fluid communication with the fluid courses formed between the blades 6*p,s*. The gage pads 5*p* may be disposed around the gage section 5 and each pad may be formed during molding of the bit body 4 and may protrude from the outer portion of the bit body. Each gage pad 5*p* may be made from the same material as the bit body 4 and each gage pad may be formed integrally with a respective blade 6*p,s*. Each gage pad 5*p* may extend upward from a shoulder portion of the respective blade 6*p,s* to an exposed outer surface of the lower shank piece.

Each gage pad 5*p* may have a rectangular lower portion and a tapered upper portion. The tapered upper portions may transition an outer diameter of the drill bit 1 from the gage diameter to a lesser diameter of the shank. Each trimmer 8 may be mounted to a leading edge of the respective lower portion of each gage pad 5*p*. The trimmers 8 may be mounted, such as by brazing, in respective pockets formed in the lower portions adjacent to the leading edges thereof. The positions of the trimmers 8 may be aligned and the trimmers may be located adjacent to a lower end of the lower portions. Each trimmer 8 may be a shear cutter including a superhard cutting table, such as polycrystalline diamond, attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table.

Figure 2A:
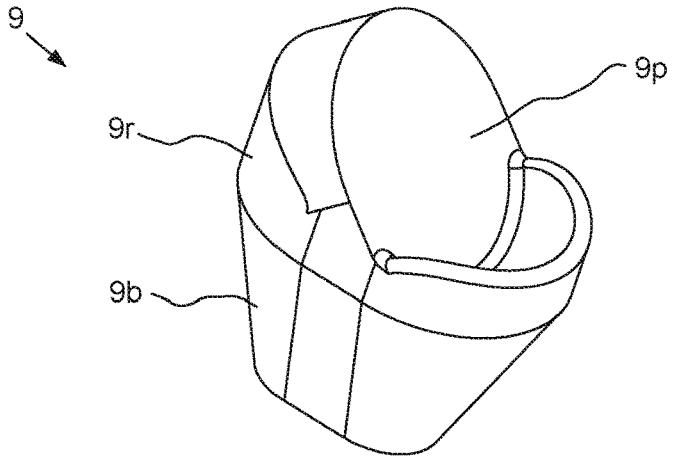
FIG. 2A illustrates a stud of the drill bit.
Figure 2B:
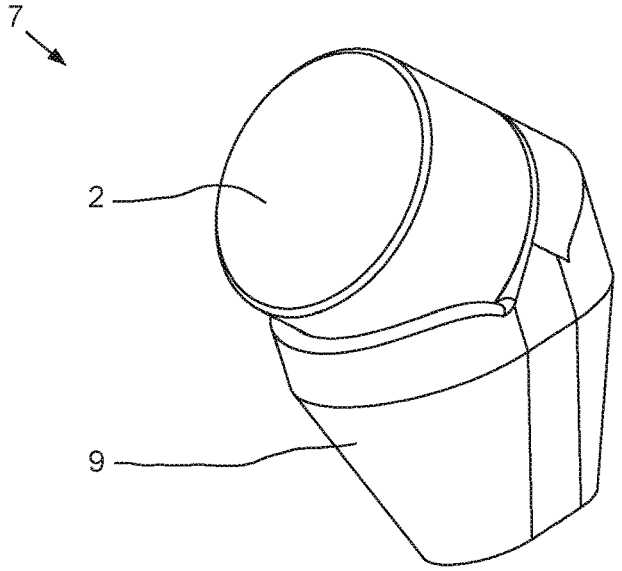
FIGS. 2B and 2C illustrate a cutter mounted to the stud.
Figure 2C:
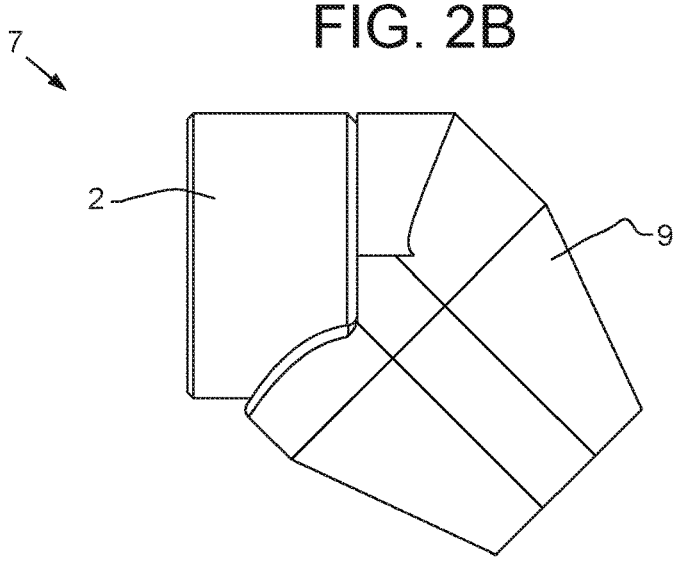
Figure 3A:
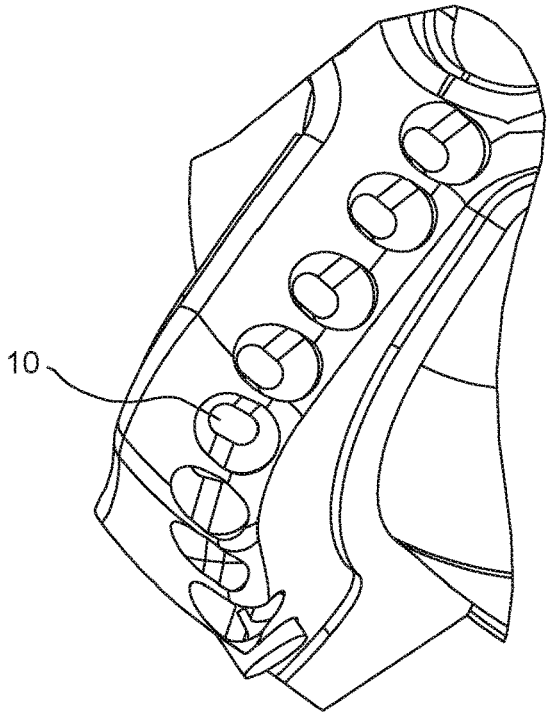
FIGS. 3A and 3B illustrate stud pockets formed along blades of the drill bit.
Figure 3B:
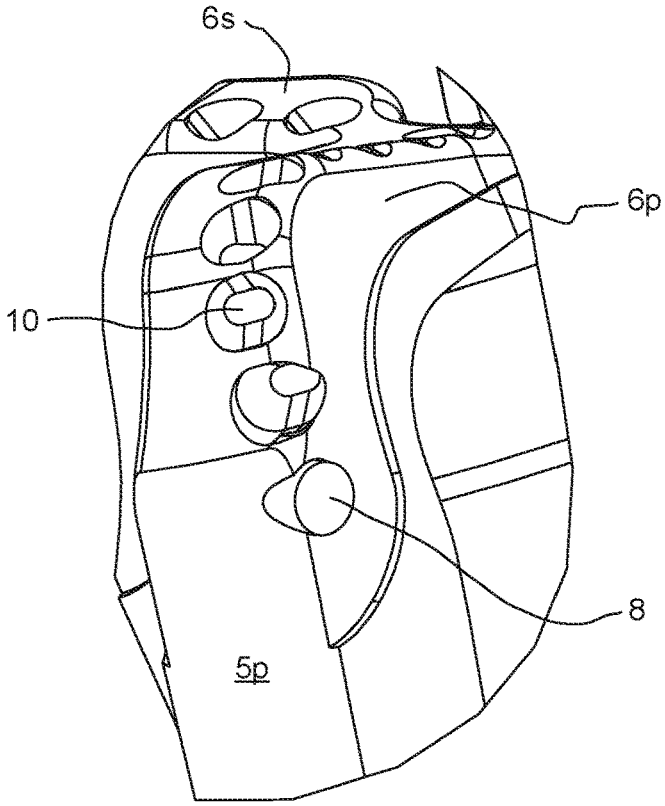
Figure 4A:
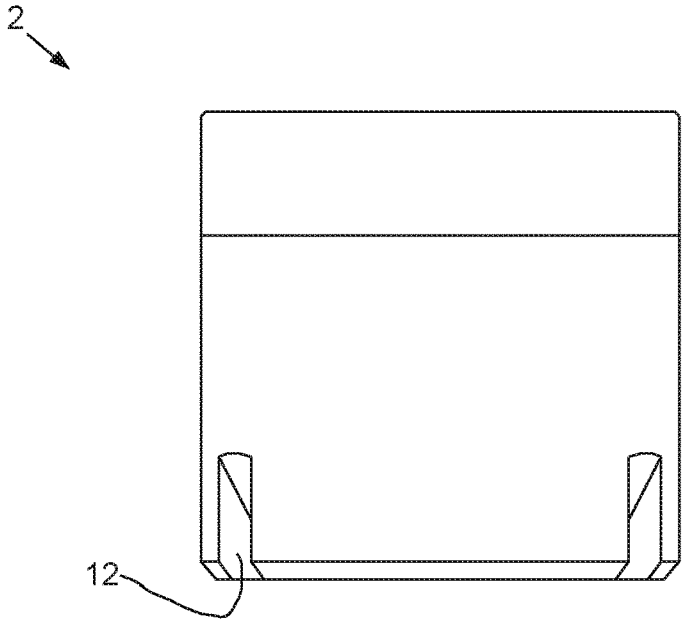
FIG. 4A illustrates a modification to the cutter for use with the stud, according to another embodiment of the present disclosure.
Figure 4B:
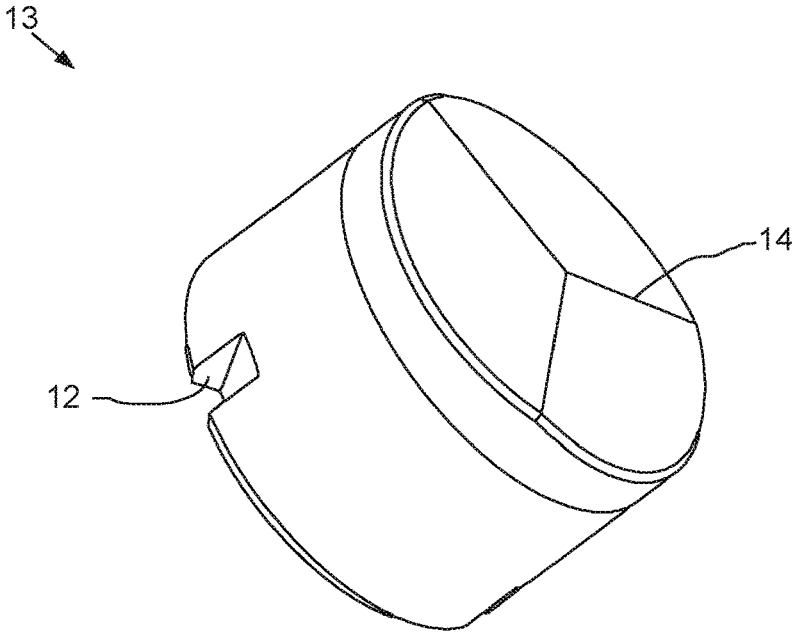
FIG. 4B illustrates an alternative cutter for use with the stud, according to another embodiment of the present disclosure.

FIG. 2A illustrates a stud 9 of the drill bit 1. FIGS. 2B and 2C illustrate a cutter 2 mounted to the stud 9. FIGS. 3A and 3B illustrate stud pockets 10 formed along blades 6*p,s* of the drill bit 1. Each cutter assembly 7 may include a stud 9 and a cutter 2 mounted to the stud.

The stud 9 may be made from a hard material, such as a cermet, such as a cemented carbide, such as tungsten carbide-cobalt. The stud 9 may be formed separately from the drill bit 1, such as by sintering. The stud 9 may include a base 9*b* and a receptacle 9*r*. The base 9*b* may have a stadium shape and may taper from an end of the stud distal from the receptacle 9*r* to the receptacle. The base 9*b* may have smaller transverse dimensions at the distal end and larger transverse dimensions at the receptacle 9*r*. The receptacle 9*r* may have an external non-tapered stadium shape and a cutter pocket 9*p* formed in an end of the receptacle distal from the base 9*b*. The cutter pocket 9*p* may be inclined relative to a longitudinal axis of the stud 9. The cutter pocket 9*p* may have flat back wall and a curved side wall. The cutter pocket 9*p* may be oriented along the rectangular side of the stadium shape.

The cutter 2 may be formed separately from the stud 9 and the drill bit 1, such as by a high pressure high temperature sintering operation. The cutter 2 may be inserted into the cutter pocket 9*p* and mounted to the stud 9, such as by brazing. The cutter 2 may be a shear cutter including a superhard cutting table, such as polycrystalline diamond, attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table.

Each blade 6*p,s* may have a row of stud pockets 10 formed along a bottom 16*b* thereof adjacent to a leading edge 16*g* thereof. The bottom 16*b* of each blade 6*p,s* may extend between the leading edge 16*g* and a trailing edge 16*t* thereof. Each stud pocket 10 may have a tapered stadium shape complementary to the shape of the base 9*b*. For the matrix bodied drill bit, the stud pockets 10 may be formed using displacements, such as graphite displacements, which may be inserted and bonded into the mold prior to pouring the body powder therein. The stud 9 of each cutter assembly 7 may be inserted into the respective stud pocket 10 and mounted to the respective blade, such as by brazing. Once the cutter assemblies 7 have been mounted to the blades 6*p,s*, the cutters 2 may be disposed adjacent to and underneath the leading edges 16*g* of the blades so that the cutters are exposed relative to the leading edges of the blades 6*p,s*. The exposure 11 of each cutter 2 may be greater than or equal to a diameter of the respective cutter. An exposure 15 of each cutter 2 relative to the bottom 16*b* of the respective blade 6*p,s* may also be greater than or equal to a diameter of the respective cutter.

The cutters 2 may be mounted to the studs 9 after the studs have been mounted to the blades 6*p,s* to minimize thermal cycles exerted on the cutters. The inclination of the cutter pockets 9*p* may account for the stud pockets being formed in the bottom of the blades 6*p,s* so that the cutters 2 may face leading sides of the blades 6*p,s*. The inclination of the cutter pockets 9*p* may also result in the cutters 2 being inclined relative to the bottom of the respective blade 6*p,s* at a backrake angle. The backrake angle may range between one and thirty degrees.

Alternatively, for a steel body drill bit, the stud pockets 10 may be milled into the blades.

A first braze material used to mount the studs 9 to the blades 6*p,s* may have a greater liquidus temperature than a second braze material used to mount the cutters 2 to the studs so that worn cutters 2 can be de-brazed from the respective studs, rotated, and re-brazed to the studs without removing the studs from the blades. The first liquidus temperature may be ten percent, twenty percent, thirty percent forty percent, or fifty percent greater than the second liquidus temperature. Each braze material may be a metal or alloy.

In use (not shown), the drill bit 1 may be assembled with one or more drill collars, such as by threaded couplings, thereby forming a bottomhole assembly (BHA). The BHA may be connected to a bottom of a pipe string, such as drill pipe or coiled tubing, thereby forming a drill string. The BHA may further include a steering tool, such as a bent sub or rotary steering tool, for drilling a deviated portion of the wellbore. The pipe string may be used to deploy the BHA into the wellbore. The drill bit 1 may be rotated, such as by rotation of the drill string from a rig (not shown) and/or by a drilling motor (not shown) of the BHA, while drilling fluid, such as mud, may be pumped down the drill string. A portion of the weight of the drill string may be set on the drill bit 1. The drilling fluid may be discharged by the nozzles and carry cuttings up an annulus formed between the drill string and the wellbore and/or between the drill string and a casing string and/or liner string.

Advantageously, when drilling through a soft formation, the high exposure 11, 15 of the cutters 2 afforded by the studs 9 allow a greater depth of cut (DOC) than prior art drill bits with less exposed cutters. This increased DOC is due to the fact that the blades will engage the soft formation and serve as DOC limiters. The increased DOC translates to increased rate of penetration, thereby reducing drilling time and associated cost. Further, the tapered bases 9*b* allow for maximum cutter density, especially in the nose 3*n* and shoulder 3*s* sections. Further, the studs 9 may provide improved cutter support compared to cutter pockets formed in the blades, thereby extending the service life of the cutters 2. Further, the studs 9 allow for increasing the exposure 11, 15 of the cutters 2 without concern to whether the drill bit 1 is matrix bodied or steel bodied.

Alternatively, the cutter pocket 9*p* may have a key formed therein, such as at the interface between the back and the side, and the cutter 2 may have keyways 12 formed in a rear edge of the substrate, such as three spaced at one hundred twenty degree intervals. The key and one of the keyways 12 may be engaged during mounting of the cutter 2 to the stud 9. When the cutter 2 is de-brazed due to wear, the cutter may then be rotated to align the key with one of the other keyways 12, and the two may then be mated during re-brazing.

Alternatively, the cutting table of each cutter 13 may have a non-planar working face located at an end thereof distal from the substrate. The working face may have a plurality of recessed bases, a plurality of protruding ribs, and an outer chamfered edge. The bases may be located between adjacent ribs and may each extend inward from a side of the cutting table. Each rib may extend radially outward from a center of the cutting table to the side. Each rib may be spaced circumferentially around the working face at regular intervals, such as at one-hundred twenty degree intervals. Each rib may have a ridge 14 and a pair of bevels each extending from the ridge to an adjacent base. The substrate may have a keyway 12 formed therein for each ridge 14. Each keyway 12 may be located at the edge of the substrate and may extend from the pocket end thereof along a portion of a side thereof. Each keyway 12 may be angularly offset from the associated ridge 14, such as being located opposite therefrom.

Alternatively, the cutting table of each cutter 2 may have a non-planar working face located at an end thereof distal from the substrate. The working face may have a plurality of recessed bases, a protruding center section, a plurality of protruding ribs, and an outer edge. Each base may be planar and perpendicular to a longitudinal axis of the cutter. The bases may be located between adjacent ribs and may each extend inward from a side of the cutting table. The outer edge may extend around the working face and may have constant geometry. The outer edge may include a chamfer located adjacent to the side and a round located adjacent to the bases and ribs. Each rib may extend radially outward from the center section to the side. Each rib may be spaced circumferentially around the working face at regular intervals, such as at one-hundred twenty degree intervals. Each rib may have a triangular profile formed by a pair of curved transition surfaces, a pair of linearly inclined side surfaces, and a round ridge. Each transition surface may extend from a respective base to a respective side surface. Each ridge may connect opposing ends of the respective side surfaces. An elevation of each ridge may be constant (shown), declining toward the center section, or inclining toward the center section. The center section may have a plurality of curved transition surfaces, a plurality of linearly inclined side surfaces, and a plurality of round edges. Each set of the features may connect respective features of one rib to respective features of an adjacent rib along an arcuate path. The elevation of the edges may be equal to the elevation of the ridges. The center section may further have a plateau formed between the edges. The plateau may have a slight dip formed therein. The substrate may have an interface at an upper end thereof and a lower end for being received in the cutter pocket 9*p*. The substrate upper end may have a planar outer rim, an inner mound for each rib, and a shoulder connecting the outer rim and each inner mound. A shape and location of the mounds may correspond to a shape and location of the ribs and a shape and location of the outer rim may correspond to a shape and location of the bases except that the mounds may not extend to a side of the substrate. Ridges of the mounds may be slightly above the bases. A height of the mounds may be greater than an elevation of the ribs. The substrate may have a keyway formed therein for each ridge of the respective rib. Each keyway may be located at the edge of the substrate and may extend from the pocket end thereof along a portion of a side thereof. Each keyway may be angularly offset from the associated ridge, such as being located opposite therefrom.

Alternatively, the cutting table of each cutter 2 may have a non-planar, such as concave, working face located at an end thereof distal from the substrate. The cutting table may have an interface with the substrate. The working face may have an outer chamfered edge, a planar rim adjacent to the chamfered edge, a conical surface adjacent to the rim, and a central crater adjacent to the conical surface. The interface may have a planar outer rim and an inner parabolic surface. The thickness of the cutting table may be a minimum at the crater and increase outwardly therefrom until reaching a maximum at the rim. The substrate may have a plurality of keyways formed therein and spaced therearound. Each keyway may be located at the edge of the substrate and may extend from the pocket end thereof along a portion of a side thereof. The alternative concave cutter may be circular-cylindrical or elliptical-cylindrical.

Alternatively, the cutting table of each cutter 2 may have a non-planar working face located at an end thereof distal from the substrate. The cutting table may have an interface with the substrate. The working face may have an outer edge and a ridge protruding a height above the substrate and at least one recessed region extending laterally away from the ridge. The ridge may be centrally located in the working face and extend across the working face. The presence of the ridge may result in the outer edge undulating with peaks and valleys. The portion of the ridge adjacent to the outer edge may be an operative portion. Since the ridge extends across the working surface, the ridge may have two operative portions. The working face may further include a pair of recessed regions continuously decreasing in height in a direction away from the ridge to the outer edge that is the valley of the undulation thereof. The ridge and recessed regions may impart a parabolic cylinder shape to the working face. The outer edge of the cutting table may be chamfered. The substrate may include a keyway for each operative portion of the ridge. Each keyway may be located at the edge of the substrate and may extend from the pocket end thereof along a portion of a side thereof. Each keyway may be angularly offset from the associated operative portion, such as being located opposite therefrom.

While the foregoing is directed to embodiments of the present disclosure, other and further embodiments of the disclosure may be devised without departing from the basic scope thereof, and the scope of the invention is determined by the claims that follow.

The invention claimed is:

1. A bit for drilling a wellbore, comprising:

a body; and a cutting face forming a lower end of the bit (in an operative position of the bit) and comprising:

a blade protruding from the body and having a plurality of stud pockets formed in a bottom of the blade adjacent to a leading edge of the blade;

a plurality of studs, each stud disposed in the respective pocket, mounted to the blade by a first braze material, and having a cutter pocket formed therein; and a plurality of cutters, each cutter having a superhard cutting table attached to a cermet substrate, disposed in the respective cutter pocket, and mounted to the respective stud by a second braze material, wherein:

the cutters are disposed adjacent to and underneath the leading edge of the blade so that the cutters are exposed relative to the leading edge and the bottom of the blade, the exposure of each cutter relative to the leading edge and the bottom of the blade is greater than or equal to a diameter of the respective cutter, and the bottom of the blade extends between the leading edge and a trailing edge of the blade.

2. The bit of claim 1, wherein each stud is made from a cermet.

3. The bit of claim 1, wherein a base of each stud is tapered so as to have smaller transverse dimensions at an end distal from the respective cutter pocket.

4. The bit of claim 3, wherein each base has a stadium shape.

5. The bit of claim 4, wherein a receptacle of each stud has an external non-tapered stadium shape and the receptacle of each stud has the respective cutter pocket formed therein in an end distal from the respective base.

6. The bit of claim 5, wherein each cutter pocket is oriented along a rectangular side of the stadium shape.

7. The bit of claim 1, wherein each cutter pocket is inclined relative to a longitudinal axis of the respective stud such that the respective cutter is inclined relative to the bottom of the blade at a backrake angle ranging between 1 and 30 degrees.

8. The bit of claim 1, wherein a liquidus temperature of the first braze material is greater than a liquidus temperature of the second braze material.

9. The bit of claim 1, wherein:

each substrate has a plurality of keyways formed therein, and each cutter pocket has a key engaged with one of the respective keyways.

10. The bit of claim 9, wherein each keyway is formed in a rear edge of the respective substrate.

11. The bit of claim 1, wherein each cutting table has a non-planar working face.

12. The bit of claim 11, wherein the non-planar working face has a plurality of protruding ridges spaced therearound.

* * * * *